US005642628A

United States Patent [19]

Whipple, III et al.

[11] Patent Number: 5,642,628

[45] Date of Patent: Jul. 1, 1997

[54] REFRIGERATOR MULTIPLEX DAMPER SYSTEM

[75] Inventors: Walter Whipple, III, Amsterdam; Thomas Arthur Brownell, Charlton, both of N.Y.; Rollie Richard Herzog, Louisville, Ky.

[73] Assignee: General Electric Company, Schenectady, N.Y.

[21] Appl. No.: 647,346

[22] Filed: May 9, 1996

Related U.S. Application Data

[63] Continuation of Ser. No. 301,761, Sep. 7, 1994, abandoned.

[51] Int. Cl.[6] ..... F25D 17/04; F24F 7/00

[52] U.S. Cl. ..... 62/186; 62/408; 165/294

[58] Field of Search ..... 62/186, 82, 228, 62/4, 180, 408, 441; 165/294, 296

[56] References Cited

U.S. PATENT DOCUMENTS

| | | | |
|---|---|---|---|
| 3,339,377 | 9/1967 | Fellwock | 62/408 |
| 4,122,687 | 10/1978 | McKee | 62/156 |
| 4,481,787 | 11/1984 | Lynch | 62/180 |
| 4,519,302 | 5/1985 | Nilsson et al. | 137/876 X |
| 4,732,010 | 3/1988 | Linstromberg et al. | 62/187 |
| 4,910,972 | 3/1990 | Jaster | 62/335 |
| 4,918,942 | 4/1990 | Jaster | 62/335 |
| 5,103,650 | 4/1992 | Jaster | 62/198 |
| 5,134,859 | 8/1992 | Jaster | 62/503 |
| 5,357,765 | 10/1994 | Thomas et al. | 62/180 |
| 5,375,428 | 12/1994 | LeClear et al. | 62/187 |

FOREIGN PATENT DOCUMENTS

| | | |
|---|---|---|
| 612965A2 | 8/1994 | European Pat. Off. . |
| 2258037 | 1/1993 | United Kingdom . |

OTHER PUBLICATIONS

Donald E. Knoop et al., "An Adaptive Demand Defrost and Two-Zone Control and Monitor System for Refrigeration Products," IEEE Transactions on Industry Applications, vol. 24, No. 2, Mar./Apr. 1988, pp. 337–342.

*Primary Examiner*—William E. Wayner
*Attorney, Agent, or Firm*—Donald S. Ingraham

[57] ABSTRACT

A refrigerator includes at least a first compartment cooled to a first temperature and a second compartment cooled to a second temperature, and a multiplex damper system disposed in a cooling-air passage so as to selectively direct the cooling-air flow from the refrigeration apparatus to the compartments. The multiplex damper system comprises a single movable control damper mounted in the cooling-air passage and a drive control system responsive to the cooling demands of the respective compartments and that is coupled to the single control damper so as to selectively dispose the control damper in a plurality of respective air flow positions. The range of air flow positions includes a first compartment-only air flow position, a second compartment-only air flow position, and at least one divided-flow position in which cooling air flow is proportionally directed into both the first and the second compartments.

29 Claims, 3 Drawing Sheets

REFRIGERATOR MULTIPLEX DAMPER SYSTEM

This application is a continuation of application Ser. No. 08/301,761 filed Sep. 7, 1994, now abandoned.

BACKGROUND OF THE INVENTION

This application is related to application Ser. No. 08/301,764 entitled "Energy Efficient Refrigerator Control System", which is assigned to the assignee of the present invention and is incorporated herein by reference.

This invention relates generally to refrigerators and in particular to damper systems for controlling the flow of air to different compartments within the refrigerator.

In most conventional refrigerators, a fan is used to produce air flow over the coils of an evaporator in order to cool the air. The cooled air then passes into a plenum in which the flow is typically split such that a portion of the air flow is directed into one or more freezer compartments and the other portion of the air flow is directed into fresh food compartments of the refrigerator. The split of air flow between the freezer and fresh food compartments is typically made by a damper that directs the majority of the air flow into the freezer compartment, which is necessary in order to maintain that compartment at a sub-freezing level.

In most conventional refrigerators the position of the damper is either fixed at time of manufacture or adjustable within a small range, either manually by the operator or by an automated control. The limits on the range of adjustment typically are such that the majority of air flow in all damper settings is still directed to the freezer compartment. A number of problems arise from the fixed damper or manually-variable damper in conventional refrigerators. For example, in refrigerators with manual control of damper position, the setting of the damper position is a trial and error process for the operator to attempt to achieve a desirable setting for the current operating conditions of the refrigerator (such as load in the respective compartments, ambient conditions around the refrigerator, etc.). Further, because the predominant cooling-air flow in both the fixed damper and manually-variable damper units is to the freezer, in some common operations, such as when the fresh food compartment door is open for a substantial amount of time for loading material into the compartment, the increased cooling load causes the refrigeration apparatus (compressor, evaporator and associated equipment) to operate, yet only a relatively small portion of the cooling-air flow is directed to the compartment in which the greatest cooling load exists. This type of operation wastes energy. Further, cooling air directed away from the freezer to the fresh food compartment has a very low humidity at fresh food compartment temperatures, causing dehydration of the stored food. In the conventional refrigerator, the defrost cycle of the freezer also requires much energy as it involves heating the evaporator or the air around the evaporator to remove the frost, after which it is necessary that the refrigeration apparatus operate to cool air for the refrigerator compartments It is thus desirable to improve the energy efficiency and temperature control in a refrigerator by control of the cooling-air flow. Ideally the air flow is controlled so that the cooled air from the refrigeration apparatus is directed only into the compartment or regions in the refrigerator that need cooling. Such an air flow control system desirably is simple, with a minimum of moving parts, and is readily incorporated into the refrigerator in the fabrication process.

It is an object of this invention to provide a refrigerator having a cooling-air flow control device that improves the energy efficiency of the refrigerator and that provides directed cooling-air flow selectively to a compartment or compartments in which a cooling demand exists.

It is a further object of this invention to provide a high reliability cooling-air flow control device having few moving parts and that is readily incorporated into the refrigerator.

SUMMARY OF THE INVENTION

In accordance with this invention, a refrigerator includes at least a first compartment cooled to a first temperature and a second compartment cooled to a second temperature, and a multiplex damper system disposed in a cooling-air passage so as to selectively couple the cooling-air flow from the refrigeration apparatus to the compartments. The multiplex damper system comprises a single movable control damper mounted in the cooling-air passage and a drive control system responsive to the cooling demands of the respective compartments; the drive control system is coupled to the single control damper so as to selectively dispose the control damper in a plurality of respective air flow positions. The range of air flow positions includes a first compartment-only air flow position, a second compartment-only air flow position, and at least one divided-flow position in which cooling air flow is directed into both the first and the second compartments. Typically one of the two compartments is cooled to maintain a temperature below freezing and one of the compartments is cooled to maintain a temperature above freezing.

The single damper typically comprises a cylindrical body that is rotatably mounted in the cooling-air passage such that air passes into the cylinder and then out of an aperture in the cylinder body into a port to direct the air flow to a desired compartment or compartments. For example, air enters axially into the cylinder and is directed radially out of the cylinder body into the selected port. The cylinder is typically driven by a motor, such as an electric motor, which comprises an axial drive apparatus, or alternatively, a radial drive apparatus.

The damper is positionable in a plurality of air flow positions in correspondence with signals generated by the drive control system, which typically includes a controller unit coupled to the damper drive apparatus. The controller comprises a control circuit that determines cooling demands in respective compartments and generates a control damper direction signal to position the damper; for example, temperature sensors can be used to generate temperature differential signals and a corresponding damper positioning signal to direct cooling-air supply to respective refrigerator compartments.

The control damper is typically disposed in the cooling-air passage so as to receive cool air passing from the refrigeration apparatus to the refrigerator compartments; alternatively, the damper is disposed in the cooling-air passage to control air exhausting from the respective compartments before it passes through said refrigeration apparatus.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
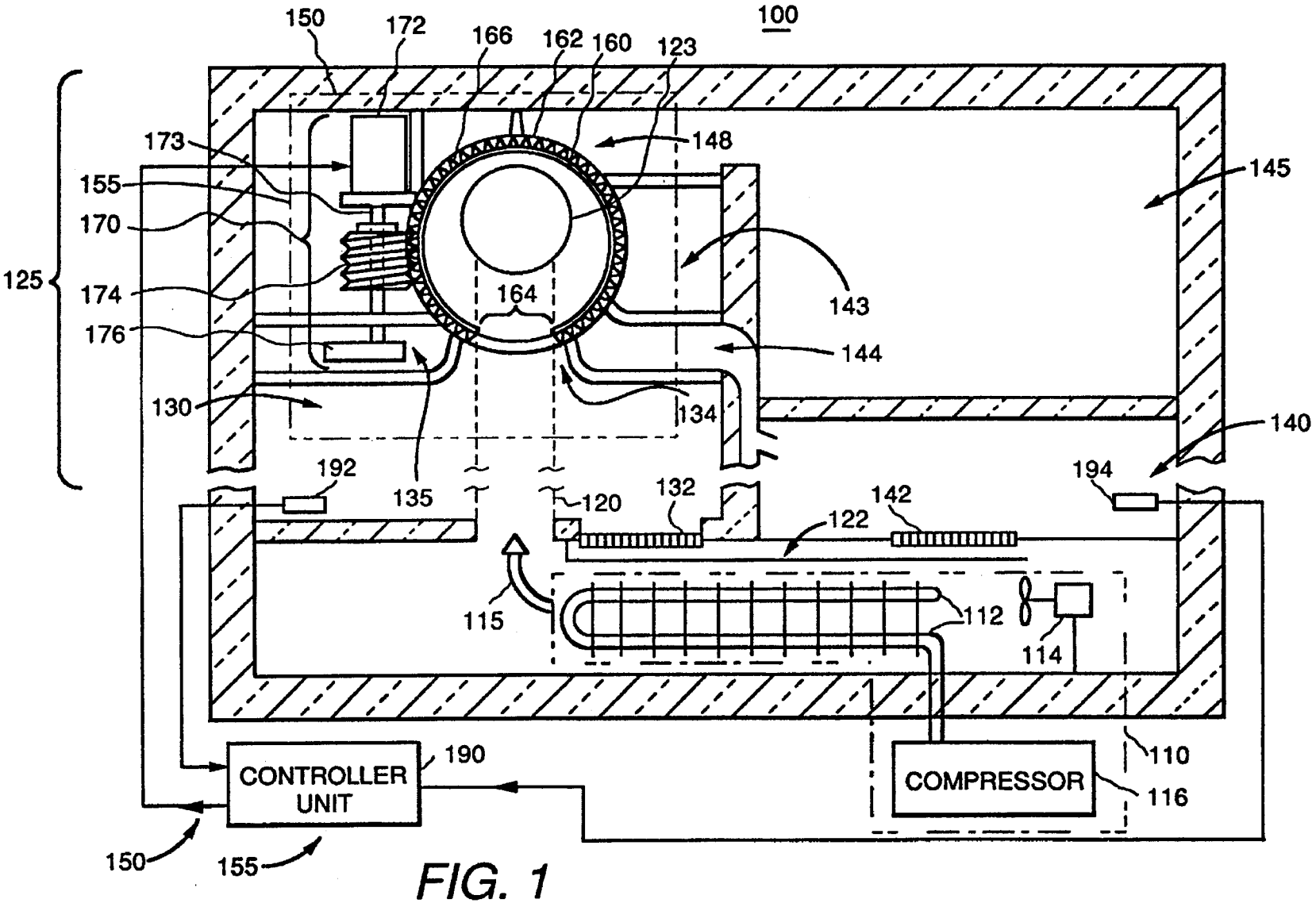
FIG. 1 is a partial schematic and partial block diagram of a refrigerator having a multiplex damper system in accordance with one embodiment of the present invention.

A refrigerator 100 in accordance with this invention, as illustrated in FIG. 1, comprises a refrigeration apparatus 110 (components outlined in phantom), at least a first compartment 130 and a second compartment 140 that are coupled to receive cooling-air from the refrigeration apparatus, and a multiplex damper system 150 (a portion of which (including the mechanical components for directing the air) is outlined in phantom in FIG. 1, and a portion of which including the damper controller is shown by a broad arrow in FIG. 1). Portions of multiplex damper system 150 (e.g., the mechanical components for directing air flow) are disposed in an air supply passage 120 to selectively direct cooling-air flow from refrigeration apparatus 110 into either first compartment 130 or second compartment 140, or alternatively to split the cooling-air flow so as to direct some of the flow into first compartment 130 and some of the flow into second compartment 140.

As used herein, "refrigeration apparatus" refers to devices or combinations of devices that are used to cool air to provide the desired temperatures in refrigerator 100. By way of example and not limitation, such a system comprises an evaporator 112 that is a heat exchanger in which heat from the air to be cooled is circulated across one side of the heat exchanger surface and heat from the air is absorbed by a refrigerant fluid circulating on the other side of the heat exchange surface. The air to be cooled is typically circulated over the heat exchange surfaces by a fan 114. For ease of illustration, fan 114 is illustrated in one position with respect to evaporator 112, but it can be positioned at other locations in air passage 120 so as to provide the desired cooling-air flow, for example, when a squirrel-cage type of fan is used, as discussed in greater detail below. Evaporator 112 is coupled to a compressor 116 in which the heated (and typically now-gaseous) refrigerant fluid is compressed and condensed before being recirculated to the evaporator through an expansion device. The refrigerant fluid is a liquid-to-gas phase changing material adapted for a particular system; Freon (referring generally to the group halogenated hydrocarbons (usually based on methane) containing one or more fluorine atoms and which are commonly used as refrigerants), including Freon 12, Freon 134A, Freon 134B, or the like are common examples of refrigerants. Alternatively, refrigeration system 110 can comprise an ammonia-based system, a thermoelectric system, or the like.

Cooled air passing from evaporator 112 is directed into cooling-air passage 120, as illustrated in FIG. 1 by cooling-air flow arrow 115 (shown as a double-line arrow). From passage 120, cooling-air flow is directed into respective refrigerator compartments (as described below); after air has circulated through respective compartments in refrigerator 100 (and cooled the compartment and its contents), the now-warmed cooling-air flow passes from the compartments respectively via first compartment vent 132 and second compartment vent 142, as illustrated by the single line arrows in FIG. 1, into an exhaust plenum 122 which directs the cooling-air flow back to fan 114 to enable the air to be recirculated over evaporator 112 for further heat transfer. Typically, the air is again cooled and cycled through refrigerator 100; in alternative modes of operation, the return air can be used for defrosting the evaporator.

By way of example and not limitation, portions of multiplex damper system 150 for directing air flow, as illustrated in FIG. 1, is disposed in cooling air passage 120 to receive the chilled cooling-air flow and direct that flow into respective refrigerator compartments. Alternatively, portions of multiplex damper system 150 for directing air flow can be disposed in exhaust plenum 122 (not illustrated) so as to control the flow of cooling-air returning to the evaporator from the compartments; such an arrangement can similarly provide control over the amount of cooling-air flow that passes through respective compartments in the refrigerator.

In accordance with this invention multiplex damper control system 150 comprises single movable control damper 160 and a damper drive control system 155 that is responsive to the cooling demands of the respective compartments in the refrigerator. As used herein, "single movable control damper" refers to a device that is movably disposed in air passage 120 so as to direct cooling-air flow to a desired compartment in refrigerator 100; in multiplex damper system 150 only control damper 160 need be moved in order to change the cooling-air flow into the refrigerator compartments. Control damper 160 is movably mounted in a manifold region 125 of air passage 120, the manifold region comprising a plurality of outlet ports leading to respective compartments in the refrigerator. Control damper 160 is coupled to damper drive control system 155 so that it can be disposed in a plurality of respective air flow positions that position the manifold in a selected position with respect to respective outlet ports in manifold region 125.

Figure 2:
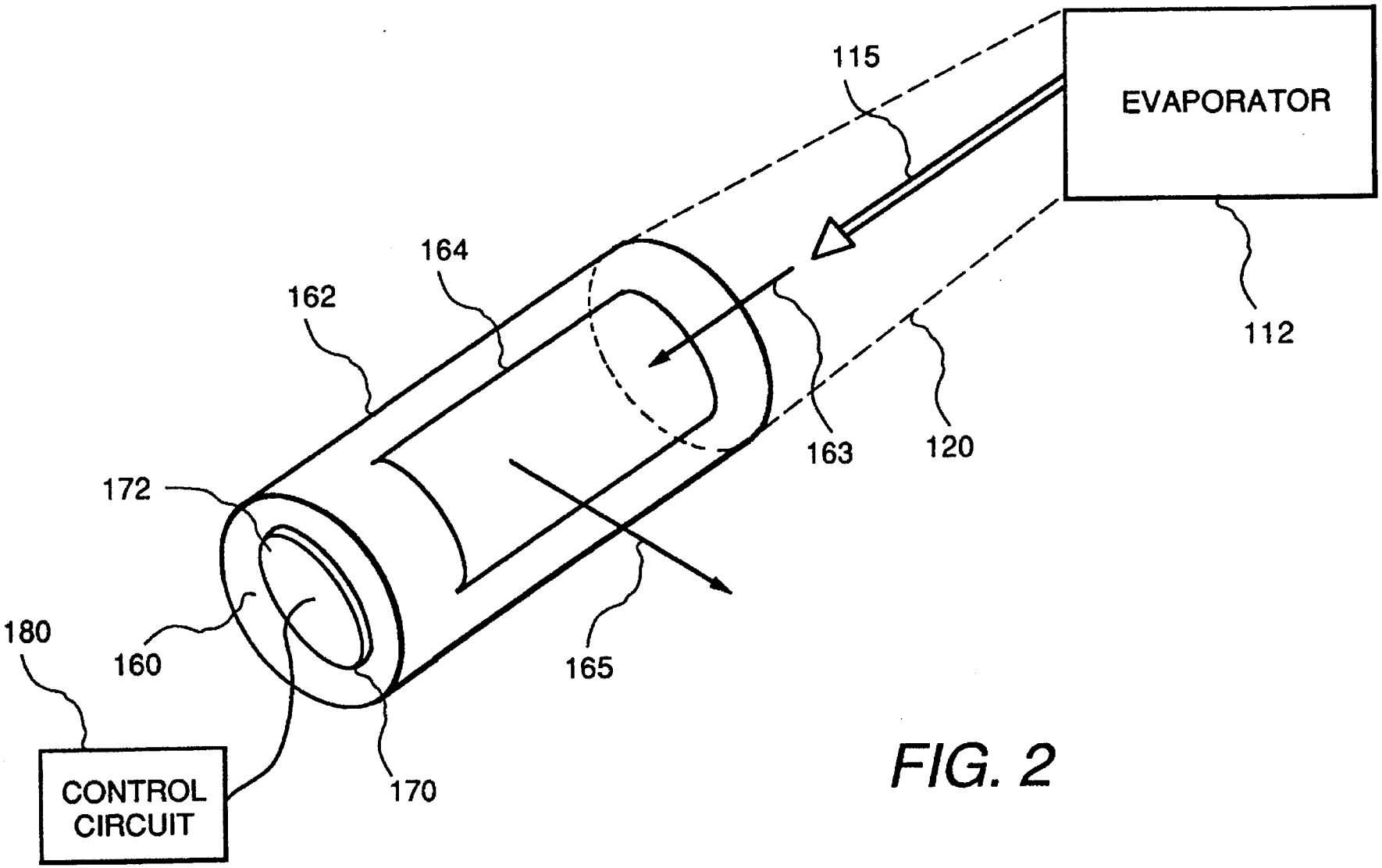
FIG. 2 is a partial schematic diagram and partial block diagram of a single control damper in accordance with one embodiment of the present invention.

Single movable control damper 160 typically comprises a cylindrical body 162 (FIGS. 1 and 2) disposed to receive cooling-air flow from a port 123 in air passage 120. By way of example and not limitation, in control damper 160 as illustrated in FIG. 2 cooling-air flow enters cylindrical body axially, that is along the longitudinal axis 163 of body 162, and is redirected through an outlet aperture 164 in body 162 so that it flows out of body 162 along a radial axis 165 of body 162 (that is, the air flows radially out of the damper). Damper 160 is movably mounted, such as with an axle or end supports (not shown), such that it can be rotated and selectively positioned in the respective air flow positions. For cylindrical body 162, such movement is about its axis so as to align aperture 164 to cause the radial flow of cooling-air to be directed to a desired compartment.

Alternatively, any combination of air flow into and out of the damper body can be used (such as radial entry to axial exit, radial entry and radial exit, or combinations thereof). In one embodiment of radial to radial flow through the damper, for example, a squirrel-cage type evaporator fan 114 is commonly disposed in port 122 (not shown) so that it draws air across evaporator 112 and exhausts the air into damper body 162. A squirrel-cage type of fan 114 operates well against the varying back pressures experienced as damper body rotates between selected air flow positions, and the squirrel cage type of fan can also be adapted to readily provide a 90° shift of direction of air flow to feed air to damper body 162 from air passage 120 (e.g., radial input to axial output). In alternative embodiments, the direction of air flow also is reversed (e.g., if the damper system is disposed to receive air passing from compartments and direct it to the evaporator).

As illustrated in FIG. 1, damper drive control system 155 comprises a drive apparatus 170 that is a radial drive apparatus. As used herein, "drive apparatus" refers to a mechanism that displaces the damper to position it to direct cooling-air flow, such as the motor drive system described below, solenoids, or the like. For example, drive apparatus 170 comprises a motor 172 coupled to an axle 173 on which a worm gear 174 is mounted so as to rotate in correspondence with the rotation of axle 173; the end of axle 173 not attached to motor 172 is supported in an axle mounting 176. Worm gear 174 engages teeth 166 disposed around the circumference (outer surface) of cylindrical body 162 such that as the worm gear turns cylindrical body 162 correspondingly turns about its longitudinal axis 163. Motor 172 typically is an electrical motor such as a stepper motor, a geared DC motor, and AC synchronous motor, or the like; alternatively non-electrical motors, such as pneumatic or hydraulic motors could be used if appropriate for a particular refrigeration device.

In another embodiment of the present invention, drive apparatus 170 is an axial drive apparatus as illustrated in FIG. 2. In this arrangement, motor 172 is coupled to cylindrical body 162 along longitudinal axis 163 such that rotation of the motor shaft causes corresponding rotation of cylindrical body 162 about its axis 163.

Figure 3:
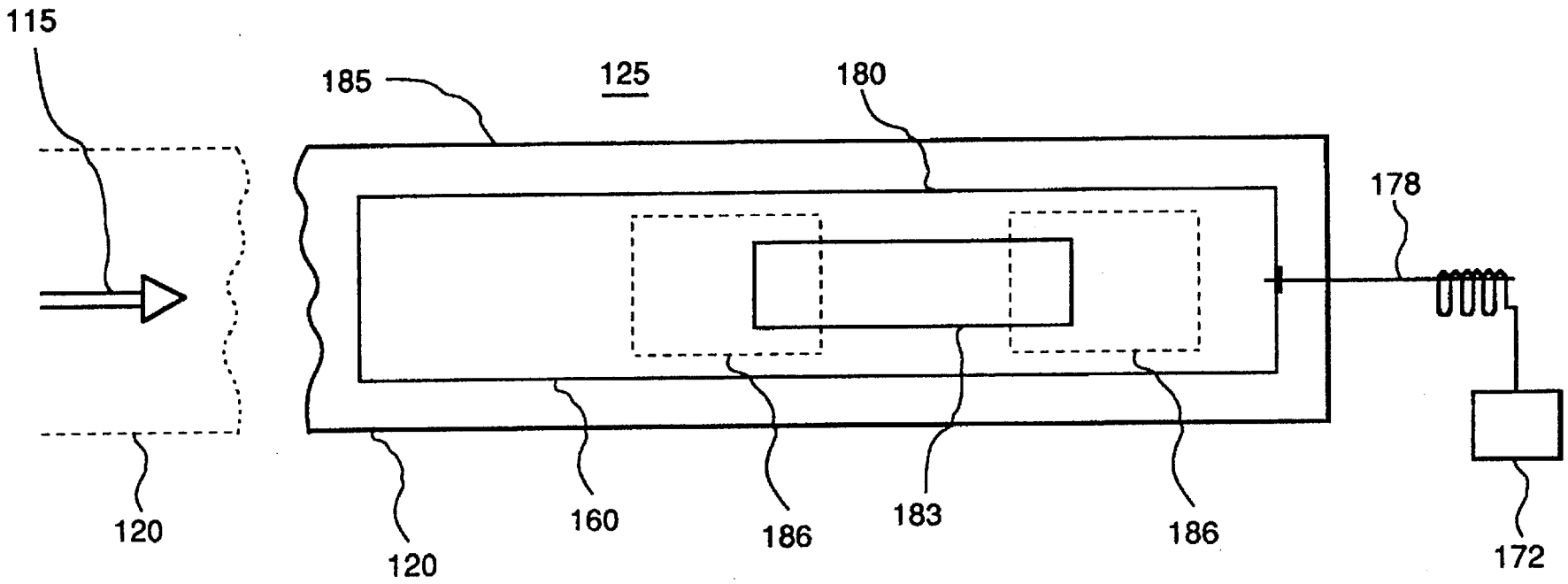
FIG. 3 is a schematic diagram of a single control damper in accordance with a further embodiment of the present invention.

In a still further embodiment of the present invention, single control damper 160 comprises a slide 180 (FIG. 3) having an outlet aperture 183 therein and that is movably disposed (such as on rollers in a guide track) in a plenum 185 that comprise manifold region 125 of air passage 120. Plenum 185 comprises a plurality of output ports 186 which are coupled to respective compartments in refrigerator 100 (by way of example, and not limitation, two representative output ports 186 are illustrated in FIG. 3 as underlying slide 180). Drive apparatus 170 comprises motor 172 coupled to slide 180 via a drive shaft 178 such that rotation of motor 172 causes motion of slide across plenum 185 such that outlet aperture 183 is disposed in a selected position with respect to respective output ports 186. The position of slide 180 is selected to expose portions (or all) of an outlet port 186 such that cooling-air flow is directed into the exposed port.

Damper drive control system 155 (FIG. 1) further comprises a control unit 190 that is coupled to damper drive apparatus 170. Control unit is adapted to provide a damper position signal that, when coupled to drive apparatus 170, causes motor 172 to drive damper 160 to a desired air flow position such that cooling-air flow is directed into a selected outlet port in manifold region 125 of air passage 120. Control unit 190 comprises sensors to determine the cooling demand of respective compartments in refrigerator 100. Cooling demand can be determined by temperature measurements, need for defrost, number of door openings of the refrigerator, ambient environmental conditions, or the like. As one example, temperature sensor 192 is disposed in first compartment 130 and temperature sensor 194 is disposed in second compartment 140. Control unit 190 may comprise an analog controller, a digital controller, or a microprocessor (also referred to as a micro-controller). By way of example and not limitation, control unit 190 in accordance with this invention may comprise a portion of an overall refrigeration system controller as is described in copending application Ser. No. 08/301,731, entitled "Energy Efficient Refrigerator Control System", which is assigned to the assignee of the present invention and is incorporated herein by reference Each temperature sensor 192, 194 is coupled to controller unit 190 to provide a signal corresponding to the temperature of the respective compartment and that enables the generation of respective differential temperature signals in controller unit 190 corresponding to the cooling demand to have the compartment at a selected temperature (such selection is typically made by the operator through a temperature selection control in the refrigerator). The differential temperature signals are processed to determine the optimal damper air flow position to meet the cooling demand in the refrigerator, and a damper drive control signal is generated and coupled to drive apparatus 170. In this example, respective temperature sensor are illustrated in first and second compartments; in alternative embodiments, respective temperature sensors need not be positioned in each respective compartment, such as in arrangements in which cooling-air passes from one compartment into another compartment prior to passing to the evaporator.

The respective temperatures of first and second compartments in refrigerator 100 are typically selected in the manufacturing process and may be adjustable within certain ranges by the operator. For purposes of describing this invention, and not limitation, the temperatures in typical refrigerator first compartment 130 is maintained at a subfreezing level (i.e., less than 32° F. at normal ambient pressures), and commonly in the range between about −5° F. and +20° F. Second compartment 140, in the typical refrigerator, is maintained at an above-freezing temperature, commonly in the range between 32° F. and 50° F. Cooling-air flow enters compartment 130 via a freezer cooling air port 134 disposed in manifold region 125 of cooling-air passage 120. As illustrated in FIG. 1, control damper 160 is positioned in a freezer-only air flow position such that outlet aperture 164 is positioned to coupled cooling-air flow from air passage 120 into first compartment 130 (as shown by the arrows in the drawing). Cooling-air passes through first compartment 130 and exits the compartment via vent 132 into exhaust plenum 122.

Similarly, control damper 160 can be disposed in a second-compartment only air flow position such that damper aperture 164 is disposed to direct cooling-air flow through second compartment cooling air port 144. Further, control damper 160 can be disposed in a split air flow position such that a portion of the cooling-air flow is directed into first compartment 130 and a portion into second compartment 140. Additionally, in accordance with this invention, control damper 160 can be disposed in air flow positions that direct between 0% and 100% of cooling-air flow from refrigeration system 110 into a respective compartment in refrigerator 100. The damper assembly is substantially air tight so that in the fully "on" (i.e., 100% flow) and fully "off" (i.e, 0% flow) positions, air flow leakage in the damper assembly (that is, directed to the non-selected compartment or into other areas of the refrigerator) is typically less than about 1% of the total cooling-air flow. Compartments in refrigerator 100 are also typically substantially air-tight such that the same cooling-air flow that is directed into the compartment is exhausted into the exhaust plenum, so long as any operator access door into the compartment is closed. The damper is adapted to have positions to direct all air flow to a respective compartment in the refrigerator, to split the air flow between compartments, or an "off" position (no communication between the normal air flow passage from the evaporator to the refrigerator compartments) that can be used when the system is shut down.

Further, in accordance with this invention, refrigerator 100 may comprise more than first and second compartments, such as a third compartment 145 and an ice maker compartment 135, each of which has a respective cooling port in manifold region 125 and thus can be coupled via control damper 160 to cooling-air passageway 120 so as to receive cooling-air flow (e.g., via third compartment cooling air port 148); these compartments may further comprise respective exhaust vents (not shown) to provide communication from the compartment to exhaust plenum 122 and respective temperature sensors (not shown) coupled to controller unit 190 such that they can be maintained at a respective temperature by multiplex damper system 150. Alternatively, refrigerator 100 can be arranged such that a compartment exhausts into another compartment, that is the cooling air flow passes through the two compartments in series rather than in parallel. In this arrangement, the compartments do not necessarily have a respective temperature sensor or exhaust port directly coupled to the exhaust plenum.

In operation, multiplex damper system 150 provides increased energy efficiency and versatility for refrigerator 100 by selectively positioning control damper 160 in an air flow position to provide optimal cooling-air flow into respective compartments and sub-compartments of refrigerator 100. For example, when cooling demands increase in the fresh food compartment (e.g., second compartment 140), as might occur after the operator access door is open for a period to load groceries into the compartment, damper system 150 detects the increased cooling demand through temperature sensor 194 that senses a rise in temperature in the compartment. Controller unit 190 then generates a damper position signal to cause drive apparatus 170 to rotate damper 160 to a fresh food-compartment only air flow position such that all cooling-air flow is directed into that compartment. In contrast to conventional fixed or manually-variable damper systems, which have a fixed division of air flow between compartments, energy is not wasted by directing more cooling-air flow into the freezer compartment in addition to the fresh food compartment. Conversely, when cooling demands are greatest in the freezer compartment, more cooling-air flow can be directed there. In other operating conditions, cooling-air flow is split between one or more compartments (or sub-compartments) to meet the respective cooling demands of each of those compartments.

Additionally, the multiplex damper system of the present invention provides an energy-saving defrost option by selecting a control damper air flow position that provides air flow through the fresh food compartment (hence the cooling air is at an above-freezing temperature), with the refrigeration apparatus compressor off, so that the air flow over the evaporator deices the evaporator (while still cooling the air sufficiently for the fresh food compartment).

The multiplex nature of the damper system thus enables all or a portion of air flow to be directed to one respective compartment (or sub-compartment), and further flow can be split between at least two compartments (or compartments and sub-compartments). While only certain features of the invention have been illustrated and described herein, many modifications and changes will occur to those skilled in the art. It is, therefore, to be understood that the appended claims are intended to cover all such modifications and changes as fall within the true spirit of the invention. For example, in the embodiments of the invention discussed above, control damper 160 comprises one outlet aperture 164; as would be apparent to one skilled in the art, damper 160 can also be designed with multiple outlet apertures, which with corresponding design of manifold region 125 of cooling-air passage 120, enables further multiplexing of cooling-air flow.

What is claimed is:

1. A refrigerator comprising a plurality of compartments cooled by a refrigeration apparatus for generating a flow of cooling air, said refrigerator comprising:

at least a first compartment cooled to a first temperature;

at least a second compartment cooled to a second temperature; and a multiplex damper system disposed in a refrigeration apparatus cooling-air passage so as to direct the cooling-air flow from said refrigeration apparatus to selected refrigerator compartments;

said multiplex damper system comprising a single movable control damper mounted in said refrigeration apparatus cooling-air passage and further comprising a drive control system responsive to cooling demands of said respective compartments and that is coupled to said single control damper so as to selectively dispose said control damper in a plurality of respective air flow positions, said plurality of air flow positions comprising a range of positions comprising a first compartment-only air flow position, at least one divided flow to both first and second compartments air flow position, and a second compartment-only air flow position.

2. The refrigerator of claim 1 wherein said first temperature is less than the freezing temperature of water and said second temperature is above the freezing temperature of water.

3. The refrigerator of claim 2 wherein said drive control system comprises an axial drive apparatus.

4. The refrigerator of claim 3 wherein said axial drive apparatus comprises a motor coupled to a rotatable cylinder drive shaft.

5. The refrigerator of claim 2 wherein said refrigerator comprises more than two compartments for cooling goods stored therein.

6. The refrigerator of claim 1 wherein said single movable control damper comprises a rotatable cylinder.

7. The refrigerator of claim 6 wherein said single movable control damper is disposed in said refrigeration apparatus cooling-air passage such that said cooling-air flow passes along the axis of said control damper.

8. The refrigerator of claim 6 wherein said single movable control damper is disposed in said refrigeration apparatus cooling-air passage such that said cooling-air flow passes along a radius of said damper.

9. The refrigerator of claim 8 wherein said single movable control damper comprises a plurality of radial air output ports.

10. The refrigerator of claim 6 wherein said refrigerator further comprises a squirrel-cage fan disposed in said cooling-air passage so as to couple cooling-air flow between said cooling-air passage and said rotatable cylinder.

11. The refrigerator of claim 6 wherein said drive control system comprises a radial drive apparatus.

12. The refrigerator of claim 11 wherein said rotatable cylinder further comprises a plurality of gear teeth disposed along the circumference of said cylinder and said radial drive apparatus comprises a motor coupled to said plurality of gear teeth disposed on said cylinder.

13. The refrigerator of claim 1 wherein said drive control system is coupled to said single control damper such that said damper is positionable in a plurality of air flow positions respectively providing air flow to said first compartment between 0% and 100% of the total refrigeration apparatus cooling-air flow supply.

14. The refrigerator of claim 1 wherein said drive control system is coupled to said single control damper such that said damper is positionable in a plurality of air flow positions respectively providing air flow to said second compartment between 0% and 100% of the total refrigeration apparatus cooling-air flow supply.

15. The refrigerator of claim 1 wherein said drive control system comprises a controller unit and a drive apparatus coupled to said single movable damper; said controller unit being coupled to said drive apparatus such that movement of said movable damper corresponds to control signals generated by said controller.

16. The refrigerator of claim 15 wherein said control signals generated by said controller further correspond to environmental factors selected from the group including frequency and duration of access door openings and ambient environmental conditions.

17. The refrigerator of claim 15 wherein said controller further comprises a temperature control circuit that generates respective compartment temperature differential control signals and a control damper direction signal corresponding to said respective compartment temperature differential control signals.

18. The refrigerator of claim 1 wherein said control damper is disposed in said refrigeration apparatus cooling-air passage so as to receive air passing from said cooling apparatus.

19. The refrigerator of claim 18 further comprising a third compartment for cooling material therein at a respective third temperature.

20. The refrigerator of claim 1 wherein said refrigeration apparatus cooling-air passage comprises a plenum having ports therein providing air flow between said cooling-air passage and said plurality of compartments and said single movable control damper comprises a slide movably disposed in said plenum so as to be positioned in each of said plurality of air flow positions.

21. A refrigerator having a plurality of compartments cooled by a refrigeration apparatus providing a cooling-air supply air flow, said refrigerator comprising:

a freezer compartment for cooling material disposed therein;

a first fresh food compartment for cooling goods stored therein at a first above-freezing temperature; and a multiplex damper system disposed in a cooling-air supply passage so as to receive said flow of cooling-air passing from said refrigeration apparatus and to selectively direct said cooling-air supply into said freezer compartment and said fresh food compartment;

said multiplex damper system comprising a single-movable control damper disposed in said cooling-air supply passage and a drive control system responsive to cooling demands of said respective compartments and that is coupled to said damper so as to selectively dispose said control damper in a plurality of respective air flow positions, said respective air flow positions determining the respective proportion of said cooling-air supply directed into each of said plurality of compartments, said respective air flow positions further including an "off" position in which no air flow communication is provided for cooling air passing from said refrigeration apparatus to any of said compartments.

22. The refrigerator of claim 21 wherein control damper is disposed in said cooling air supply passage so as to have a freezer compartment-only air flow position, at least one divided flow to both freezer and fresh food compartments air flow position, and a fresh food compartment-only air flow position.

23. The refrigerator of claim 22 wherein said freezer compartment further comprises an ice maker region, and said control damper is disposed in said cooling-air supply passage so as to have an ice-maker position such that substantially all cooling-air flow directed to said freezer compartment is ported to said ice maker region.

24. The refrigerator of claim 21 wherein said fresh food compartment further comprises sub-compartments therein, said control damper being disposed in said cooling-air supply passage so as to have respective sub-compartment positions so as to direct a selected proportion of said cooling-air flow into said sub-compartments.

25. The refrigerator of claim 21 wherein said freezer compartment and said fresh food compartment each further comprise at least one respective operator access door, a cooling-air supply port, and a cooling-air exhaust port.

26. The refrigerator of claim 21 wherein said drive control system comprises:

a plurality of cooling demand sensors disposed to sense respective cooling demand in said freezer compartment and said fresh food compartment;

a control circuit coupled to said cooling demand sensors and to generate a damper position signal; and a drive apparatus coupled to receive said damper position signal and further coupled to said control damper so as to dispose said damper in an air-flow position corresponding to said damper position signal.

27. The refrigerator of claim 26 wherein said control damper comprises a cylindrical body into which said cooling-air flow from said refrigeration apparatus enters said body axially.

28. The refrigerator of claim 27 wherein said drive apparatus is coupled to said cylindrical body so as to rotate said cylindrical body about the longitudinal axis of said body.

29. The refrigerator of claim 28 wherein said cooling-air supply passage comprises a distribution manifold having ports for each respective compartment and sub-compartment to which cooling-air flow is directed, said control damper being movably disposed in said distribution manifold and positionable so as to direct at least a portion of said cooling-air flow into each of said compartments and sub-compartments.

* * * * *